United States Patent [19]

Townsend

[11] Patent Number: 4,467,543

[45] Date of Patent: Aug. 28, 1984

[54] BILLBOARD APPARATUS

[76] Inventor: Larry G. Townsend, First National Tower, Louisville, Ky. 40202

[21] Appl. No.: 462,539

[22] Filed: Jan. 31, 1983

[51] Int. Cl.[3] ..... G09F 15/00

[52] U.S. Cl. ..... 40/624; 40/611; 40/152; 40/156; 40/157

[58] Field of Search ..... 40/624, 611, 617, 10 D, 40/620, 622, 152, 152.1, 156, 157, 570; 248/568, 570, 573, 578

[56] References Cited

U.S. PATENT DOCUMENTS 2,928,199 3/1960 Novak ..... 40/152.1

4,021,949 5/1977 Niehaus et al. ..... 40/617

*Primary Examiner*—Robert Peshock

*Assistant Examiner*—Cary E. Stone

[57] ABSTRACT

A billboard apparatus includes a back for mounting to a support surface and including a pair of bottom tabs extending outwardly of the perimetric edge of the back. A pair of top tabs extend outwardly of the top edge of the back in a position and direction opposite the bottom tabs. A cover includes a planar body and a perimetric wall defining opposed pairs of bottom and top slots positioned to receive the bottom and top tabs, respectively, of the back. A pair of spring arms extend from the bottom edge of the back and engage the perimetric wall of the cover to urge the cover downwardly, thereby retaining the top tabs within the top slots. The bottom tabs extend sufficiently downward to be retained in the bottom slots when the cover is mounted on the back and resting with the perimetric wall lying against top edge of the back.

7 Claims, 6 Drawing Figures

BILLBOARD APPARATUS

BACKGROUND OF THE INVENTION

1. Field of the Invention

The present invention relates to the field of billboards and other advertising media, and in particular to billboards or placards for display of relatively small advertising messages in locations such as hallways or public restrooms.

2. Description of the Prior Art

Advertising media is displayed in a variety of fashions depending on the location of the display and the nature of the advertising media. In certain instances, it is desirable to display relatively small advertising messages in the manner of a billboard placed on walls in hallways or public restrooms. In these instances, it is further advantageous to provide a display billboard which will secure the advertising material from damage or vandalism, and yet will permit ready access to the material for insertion and removal.

Prior art devices have usually comprised a simple mounting bracket which is secured to the wall and receives the advertising material within an exposed slot. The material simply slides into the slot, typically from above, and rests in the bracket for display. In these cases, the material is readily accessed, but is susceptible to damage or removal. Other display boards have included a glass or other clear cover which is removable to permit insertion of the advertising or informational material. In these instances, the cover usually fits within a frame received upon a supporting back, and the cover is either removed or pivots from the back for purposes of inserting or removing the material. The ease of access to the material is limited by the fact that in many instances it is necessary to have certain tools such as pliers or screwdrivers, or to have keys or the like for opening locks.

These prior art devices have been suitable for the purposes described. However, the present invention is directed to providing an improved billboard apparatus satisfying these purposes and having enhanced features as to appearance, ease of access, and securement of the advertising material against damage and vandalism. At the same time, the need for special tools or keys to obtain access to the interior of the billboard is avoided.

SUMMARY OF THE INVENTION

Briefly describing one aspect of the present invention, there is provided a billboard apparatus including a back having a pair of opposed tabs extending outwardly therefrom, a cover including slots for securing the cover to the back by the reception therein of the opposed tabs of the back, and spring means for urging the cover in a direction to retain the cover on the back.

It is an object of the present invention to provide a billboard apparatus for the reception and display of advertising and informational material and the like, particularly in public areas such as hallways or public restrooms.

Another object of the present invention is to provide a billboard apparatus including a cover mounted to a back such that the displayed material is secured against damage and vandalism.

It is a further object of the present invention to provide a billboard apparatus which includes a cover mounted to a back in such a way as to provide firm securement therewith and to discourage or prevent removal by unauthorized persons, while enabling removal by knowledgeable persons without the use of special equipment such as tools or keys.

Further objects and advantages of the present invention will become apparent from the description of the preferred embodiment which follows.

DESCRIPTION OF THE PREFERRED EMBODIMENT

Figure 1:
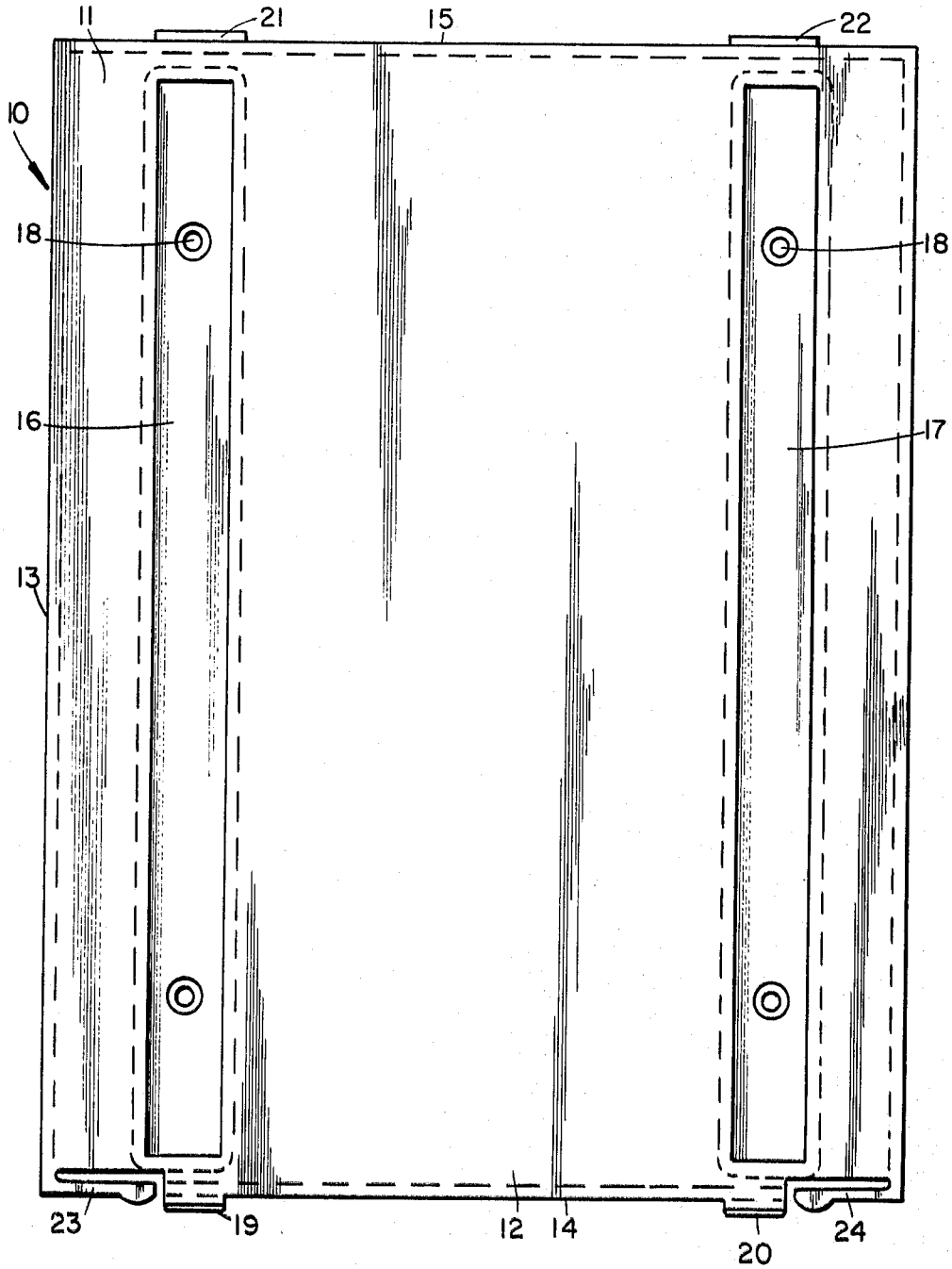
FIG. 1 is a front, elevational view of the back member useful in the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawings, there is shown a billboard apparatus 10 constructed in accordance with the present invention. The billboard includes a back 11 having a generally planar, rectangular configuration. The back may be formed from a variety of materials, and preferably constitutes a black, high impact polystyrene plastic. The back has a body portion 12 and a perimetric edge 13 including a bottom edge 14 and an opposed, top edge 15. A pair of vertical channels 16 and 17 are formed in the body portion 12 and serve to provide strengthening of the back and also facilitate mounting of the back to a support surface such as a wall. Holes such as 18 are located within the channels for the reception of mounting screws, bolts or the like.

Figure 3:
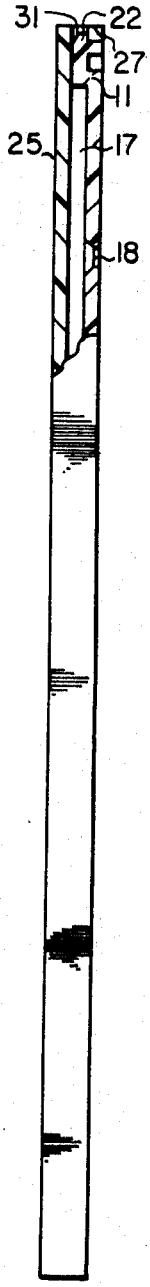
FIG. 3 is a side, elevational view, partially in cross section, showing the cover mounted to the back.
Figure 4:
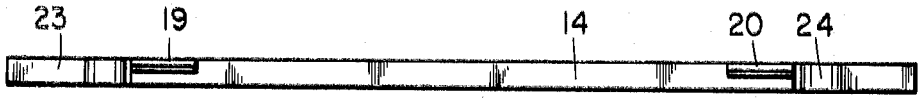
FIG. 4 is a bottom, plan view of the back of FIG. 1.

A pair of tabs 19 and 20 extend downwardly in FIG. 1 from the bottom edge 14 of the back. A pair of tabs 21 and 22 extend upwardly in FIG. 1 from the top edge 15 of the back and are generally opposed to the bottom tabs in direction and location. It will be appreciated that various locations and numbers of these tabs would be suitable for use in the manner described herein. As seen particularly in FIG. 3, the tabs are preferably formed integral with the body portion of the back and lie flush with the front surface of the planar body. Again, it will be appreciated that the tabs may be located in various positions to achieve proper mounting of the cover to the back in accordance with the principles set forth herein.

A pair of spring arms 23 and 24 are also formed integrally with the back and located at the bottom edge 14. At the end of each arm is a rounded surface which is positioned outwardly of the bottom edge 14. In this manner, the placement of the cover onto the back will cause the cover to engage the spring arms prior to engagement of the bottom edge causing the arms to be bowed inwardly to provide a resisting tension against the cover.

Figure 5:
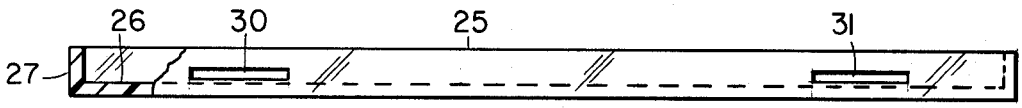
FIG. 5 is a top, plan view, partially in cross section, of the front of FIG. 2.
Figure 2:
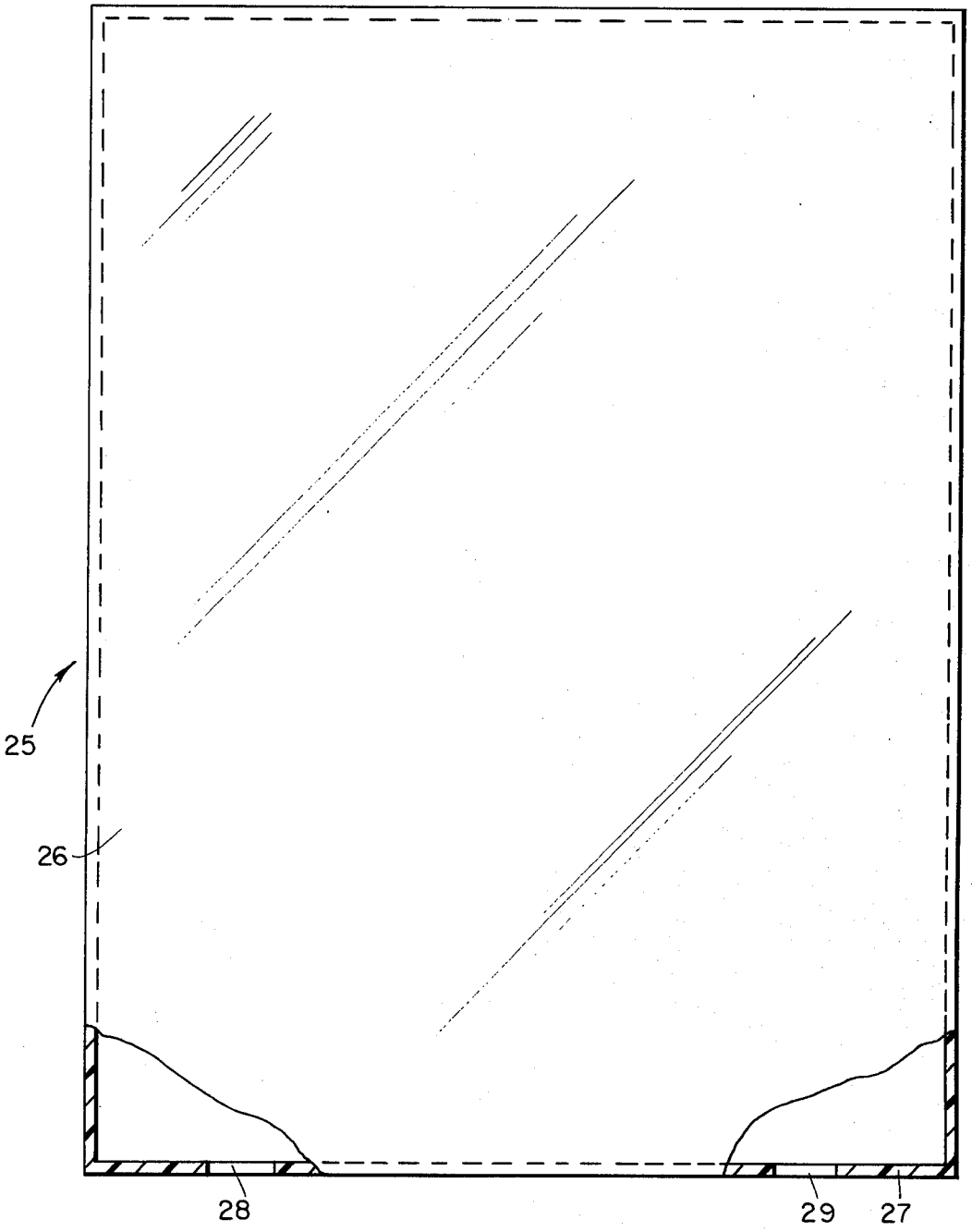
FIG. 2 is a front, elevational view, partially in cross section, of the front member useful in the preferred embodiment of the present invention.
Figure 6:
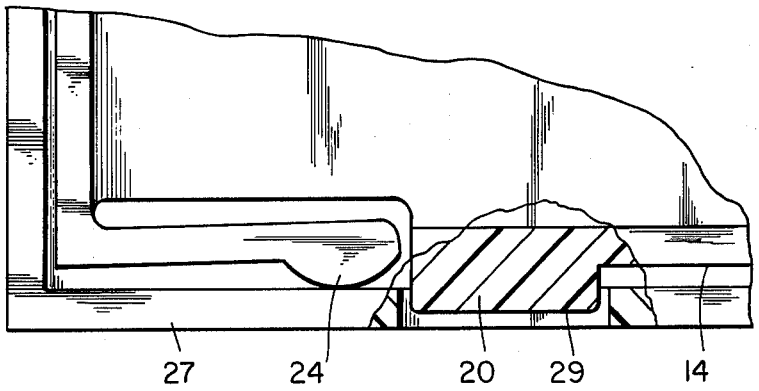
FIG. 6 is a rear, elevational view of a portion of the present invention, particularly showing the cover mounted to the back and with a bottom tab received within a bottom slot, and a spring arm bowed in resistance thereto.

In FIG. 2 there is shown a preferred form of the cover 25 used in conjunction with the present invention. The cover is preferably a fully clear plastic case, although it would be equally suitable to have only a portion, such as the front surface, clear with the remainder not being clear. The cover 25 is also a generally planar, rectangular member having a body portion 26 and a perimetric wall 27 extending rearwardly therefrom. The cover defines in the perimetric wall 27 a pair of bottom slots 28 and 29 and a pair of top slots 30 and 31 (FIG. 5). The cover and slots are positioned and configured complementary with the back and tabs such that the tabs 19–22 are receivable within the slots 28–31, respectively and the perimetric wall 27 of the cover is received adjacent the perimetric edge 13 of the back.

The configuration and the tabs and the spring arms is such that the spring arms will urge the cover downwardly upon the top tabs 21 and 22 to retain the cover on the back. In operation, the cover is mounted to the back by first manipulating the cover so that the bottom tabs 19 and 20 are received within the bottom slots 28 and 29. The tabs extend outwardly a sufficient distance that the cover is engaged by the spring arms before the top slots are in positioned over the top tabs. Therefore, the cover must be urged upwardly against the resistance of the spring arms in order to raise the top of the perimetric wall over the outermost extent of the top tabs so that the top tabs can be inserted into the top slots. When the cover is released, the spring arms will then urge the cover downward to retain the top tabs within the top slots. At the same time, the bottom tabs extend outwardly enough that they remain received within the bottom slots even when the cover is resting with the inner surface of the top portion of the perimetric wall lying against the outer surface of the perimetric edge of the back. This typically requires that the distance between the inner surfaces of the opposed portions of the perimetric wall of the cover, adjacent the slots, be less than the distance spanning from the outer tip of the top tab to the outer tip of the bottom tab.

For removal, the cover is simply moved upwardly against the resistance of the spring arms until the top of the perimetric wall clears the tips of the top tabs. The cover may then be swung slightly forward so that it may be lowered off of the lower tabs. The construction of the present invention is therefore seen to provide a manner for mounting a cover to a back in a fashion which provides a secure and full enclosure of advertising material received therebetween. At the same time, the mounting is performed in such a manner as to avoid the need for special equipment such as tools or keys to effect removal of the cover.

By proper sizing of the components of this invention, the manner of connection of the cover to the back is also well masked from the casual observer. As shown, the tabs are made flush with the front surface of the back. Also the slots are located adjacent the inside surface of the cover. In this manner, the inner surface of the cover is located closely to the front surface of the back to firmly engage the advertising material received therebetween and at the same to minimizes the visibility of the connection mechanism. Similarly, the tabs are preferably made to firmly fit within the slots and not to extend outwardly of the slots, again serving to enhance the physical connection of the cover and back while at the same time making the manner of connection less noticeable. Finally, the perimetric wall of the cover is preferably made to extend flush with the back of the cover to provide an aesthetic appearance, and to make a secure packaging of the advertising media.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What I claim is:

1. A billboard apparatus for providing an advertisement or the like in a protected enclosure, the apparatus comprising:

a back having a planar, rectangular configuration defining a perimetric edge, said back including a first tab extending outwardly from the perimetric edge in a first direction and a second tab extending outwardly from the perimetric edge at a location opposite the first tab and in a second direction opposite the first direction;

attachment means for attaching said back to a support surface;

a cover removably mounted on said back, said cover shaped and configured complementary to said back, said cover being at least partially transparent, said cover including a perimetric wall receivable adjacent the perimetric edge of said back, the perimetric wall including first and second slots positioned to receive therein the first and second tabs, respectively, of said back when said cover is positioned against said back with the perimetric wall adjacent the perimetric edge of said back; and spring means for urging the perimetric wall of said cover in a direction outward from the first tab in a direction to normally displace the cover from the first tab when said cover is mounted to said back with the first slot in the perimetric wall receiving the first tab therein, the perimetric wall and the first and second tabs being sized such that the distance between the first and second slots is less than the distance from the outward tip of the first tab to the outward tip of the second tab, whereby said cover is firmly attached to said back by mounting said cover to have the first tab received within the first slot, moving said cover toward the second tab against the resistance of said spring means until the second tab may be received within the second slot, and releasing said cover to be held in position by the tabs and said spring means.

2. The apparatus of claim 1 in which the first tab extends outwardly from the perimetric edge of said back a distance less than the thickness of the perimetric wall adjacent the first tab.

3. The apparatus of claim 1 in which said spring means includes a spring arm mounted to said back adjacent the first tab and positioned to engage the perimetric wall of said cover when said cover is mounted to said back with the first tab received within the first slot.

4. The apparatus of claim 1 and which includes a third tab mounted to said back adjacent the first tab and a fourth tab mounted to said back adjacent the second tab, said cover including third and fourth slots positioned to received therein the third and fourth tabs, respectively.

5. The apparatus of claim 4 in which the first tab extends outwardly from the perimetric edge of said back a distance less than the thickness of the perimetric wall adjacent the first tab.

6. The apparatus of claim 4 in which said spring means includes a spring arm mounted to said back adjacent the first tab and positioned to engage the perimetric wall of said cover when said cover is mounted to said back with the first tab received within the first slot.

7. The apparatus of claim 6 in which the first tab extends outwardly from the perimetric edge of said back a distance less than the thickness of the perimetric wall adjacent the first tab.

* * * * *